US010501149B1

(12) United States Patent
Hall

(10) Patent No.: US 10,501,149 B1
(45) Date of Patent: Dec. 10, 2019

(54) DRAFT ADJUSTABLE WATERCRAFT

(71) Applicant: Danny R. Hall, Ellijay, GA (US)

(72) Inventor: Danny R. Hall, Ellijay, GA (US)

( * ) Notice: Subject to any disclaimer, the term of this patent is extended or adjusted under 35 U.S.C. 154(b) by 0 days.

(21) Appl. No.: 16/014,637

(22) Filed: Jun. 21, 2018

Related U.S. Application Data

(60) Provisional application No. 62/522,761, filed on Jun. 21, 2017.

(51) Int. Cl.
*B63B 1/22* (2006.01)
*B63B 1/20* (2006.01)
*B63B 1/04* (2006.01)

(52) U.S. Cl.
CPC ..... *B63B 1/22* (2013.01); *B63B 1/042* (2013.01); *B63B 1/20* (2013.01); *B63B 2001/201* (2013.01); *B63B 2001/206* (2013.01)

(58) Field of Classification Search
CPC .. B63B 1/22; B63B 1/042; B63B 1/20; B63B 2001/201; B63B 2001/206
See application file for complete search history.

(56) References Cited

U.S. PATENT DOCUMENTS

| | | | | |
|---|---|---|---|---|
| 2,985,130 | A | 7/1958 | Jacobs et al. | |
| 3,120,210 | A | 2/1964 | Molotzak | |
| 3,559,222 | A | 2/1971 | Walker | |
| 5,390,623 | A | 2/1995 | Mackaness | |
| 6,895,883 | B2 | 5/2005 | Coles | |
| 7,228,810 | B2 | 6/2007 | Brown | |
| 8,065,970 | B2 | 11/2011 | Sorrentino | |
| 8,201,513 | B2 * | 6/2012 | Hansen | B63B 1/22 114/284 |
| 8,783,200 | B1 | 7/2014 | Meyers | |
| 8,955,452 | B1 * | 2/2015 | Wilson | B63B 1/22 114/284 |
| 9,156,372 | B1 * | 10/2015 | Guglielmo | B60L 15/00 |
| 9,233,732 | B2 * | 1/2016 | Wilson | B63B 1/20 |
| 9,315,234 | B1 * | 4/2016 | Kennamer, Sr. | B63H 5/125 |
| 10,000,258 | B2 * | 6/2018 | Curtis | B63B 1/107 |
| 2005/0034647 | A1 * | 2/2005 | Amraly | B63B 1/14 114/284 |
| 2006/0162639 | A1 * | 7/2006 | Costello | B63H 5/14 114/284 |
| 2010/0024707 | A1 * | 2/2010 | Curatolo | B63B 43/12 114/271 |
| 2010/0269747 | A1 * | 10/2010 | Hansen | B63B 1/22 114/289 |
| 2011/0005451 | A1 * | 1/2011 | Ezra | B63H 25/44 114/284 |
| 2015/0266554 | A1 * | 9/2015 | Rolla | B63H 5/16 440/68 |

* cited by examiner

*Primary Examiner* — S. Joseph Morano
*Assistant Examiner* — Jovon E Hayes
(74) *Attorney, Agent, or Firm* — Cramer Patent & Design, PLLC; Aaron R. Cramer

(57) ABSTRACT

A watercraft has a hull with a central portion which selectively raises from a lower position to a recessed position within a tunnel of the boat hull with a hydraulically controlled means. The hydraulically controlled means is disposed within the hull and adjacent the tunnel. A motor mount is in mechanical communication with the adjustable portion of the boat hull and raises or lowers correspondingly with the adjustable portion of the boat hull.

8 Claims, 4 Drawing Sheets

DRAFT ADJUSTABLE WATERCRAFT

RELATED APPLICATIONS

The present invention was first described in and is a continuation-in-part of U.S. Provisional Patent Application No. 62/522,761 filed on Jun. 21, 2017, the entire disclosures of which are incorporated herein by reference.

FIELD OF THE INVENTION

The present invention relates generally to the field of a draft adjustable watercraft.

BACKGROUND OF THE INVENTION

Boating is a pastime enjoyed every day by many people across the world. Whether boating to fish, travel or the mere enjoyment of operating a boat, a situation appropriate watercraft is a necessary component for any such activity.

As most people who enjoy boats know, boats and boat hulls come in many different shapes and sizes, with a particular shape and size often being dictated by the type of activity intended. For example, a planing boat is design to rise upon the top of the water as the boat gains speed and may often be used to tow water-skiers while a flat bottom boat is often considered ideal for fishing in calm and shallow waters.

These are but a few of the types of boat hulls available and while each has the aforementioned advantages, they also have disadvantages. Whereas a planning boat hull might be more stable in rough waters at high speeds they are not likely to be of great use in shallow water while the flat bottom boat or tunnel boat is great for navigating in shallow water but is not as stable and therefore ill-suited for rough and choppy water. Therefore, an ideal boat hull would be one which combines the stability of a planing boat with the ability to navigate in shallow waters of a flat bottom boat into one (1) watercraft.

Some efforts to address this issue have been made in the form of U.S. Pat. Nos. 8,783,200, 3,559,222 and U.S. Pat. App. Pub. No. 2010/0024707. However, these solutions are not satisfactory. As such, there is a need for a draft adjustable watercraft that selectively permits an operator to modify the hull from a planing or deep "V" configuration to a flat bottom or tunnel hull as needed. The present invention fulfills this need.

To achieve the above and other objectives, the present invention provides for such a watercraft which comprises a hull having an exterior hull channel within a hull bottom and adjacent a watercraft stern, an adjustable hull adjustably secured within the hull channel in mechanical communication with a hull adjustment assembly and a control in electrical communication with the hull adjustment assembly and a power source. The control permits a user to selectively raise or lower the adjustable hull within the hull channel.

The hull adjustment assembly may comprise a hydraulic assembly which in turn may comprise a hydraulic cylinder secured at a first end to an exterior surface of the hull channel and a hydraulic piston in mechanical communication with the hydraulic cylinder and the piston being secured to the adjustable hull at a hydraulic piston first end.

The piston first end may be secured to a pivot point first end while a pivot point second end is secured to the adjustable hull. The control may comprise a first switch. The control may further comprise a second switch. The first switch may raise the adjustable hull. The second switch may lower the adjustable hull. The hull channel and adjustable hull may each comprise a polygonal cuboid shape.

In a separate embodiment, the hydraulic lifting system is replaced with a manually operated arm which is secured to a handle at a first end and secured to the adjustable hull at a second end. A user may pull the adjustable hull up or push the adjustable hull down. The manually operated arm may come with a locking device capable of securing the same into position.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
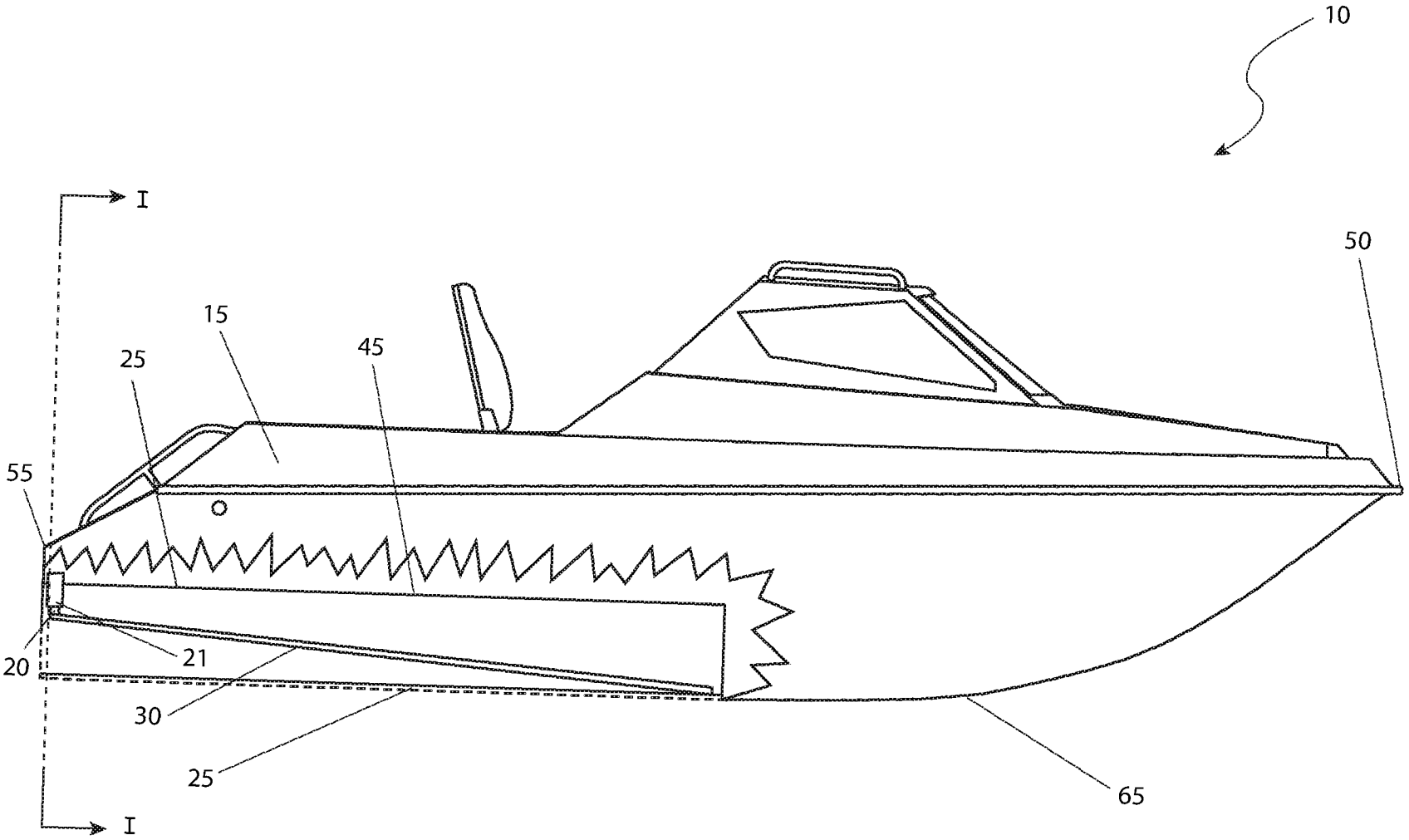
FIG. 1 is a side view of a watercraft 10, showing a cut away section of the stern 55 according to the preferred embodiment of the present invention.

10 watercraft
15 starboard side hull
20 hydraulic piston
21 hydraulic cylinder
25 adjustable hull channel
30 adjustable hull
35 port side hull
45 watercraft deck
50 bow
55 stern
65 hull bottom
70 switch
75 pivot point
80 manual lifting means
85 central shaft
90 top handle
95 adjustable locking means
100 offset section

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, is a side view of a watercraft 10 ("watercraft"), showing a cut away section of the stern 55 on the starboard side 15 according to the preferred embodiment of the present invention is disclosed. The watercraft 10 comprises a hull having a starboard side 15, a port side 35 (See FIGS. 2-4), a bow 50, a stern 55, and a hull bottom 65.

Located within the hull bottom 65 adjacent the stern 55 is an adjustable hull channel 25 configured to moveably retain therein an adjustable hull 30. The adjustable hull channel 25 and adjustable hull 30 are shown as being polygonal cuboids having a generally flat shape for purposes of illustration. However, it is understood that other configurations including some curved features, any pair of nesting shapes, or the like could be accommodated by the teachings of the present invention, and as such, should not be interpreted as a limiting factor of the present invention. There are hydraulic mechanisms positioned in the middle of the adjustable hull 30. A hydraulic piston 20 is movable in a hydraulic cylinder 21 The cylinder 21 is connected to an underside of the deck 45 in the hull channel 25 and the piston 20, is mounted to the adjustable hull 30 (See FIGS. 2-3). The hydraulic mechanism is in mechanical and electrical communication with a switch 70 which permits an operator to actuate the hydraulic mechanism thereby raising or lowering the adjustable hull 30 inside or outside the adjustable hull channel 25. It is appreciated that a single switch 70 exists to operate the hydraulic piston or in another embodiment a first switch could activate the hydraulic mechanism in a first direction and a second switch could activate the hydraulic mechanism in a second, or opposite direction.

Figure 2:
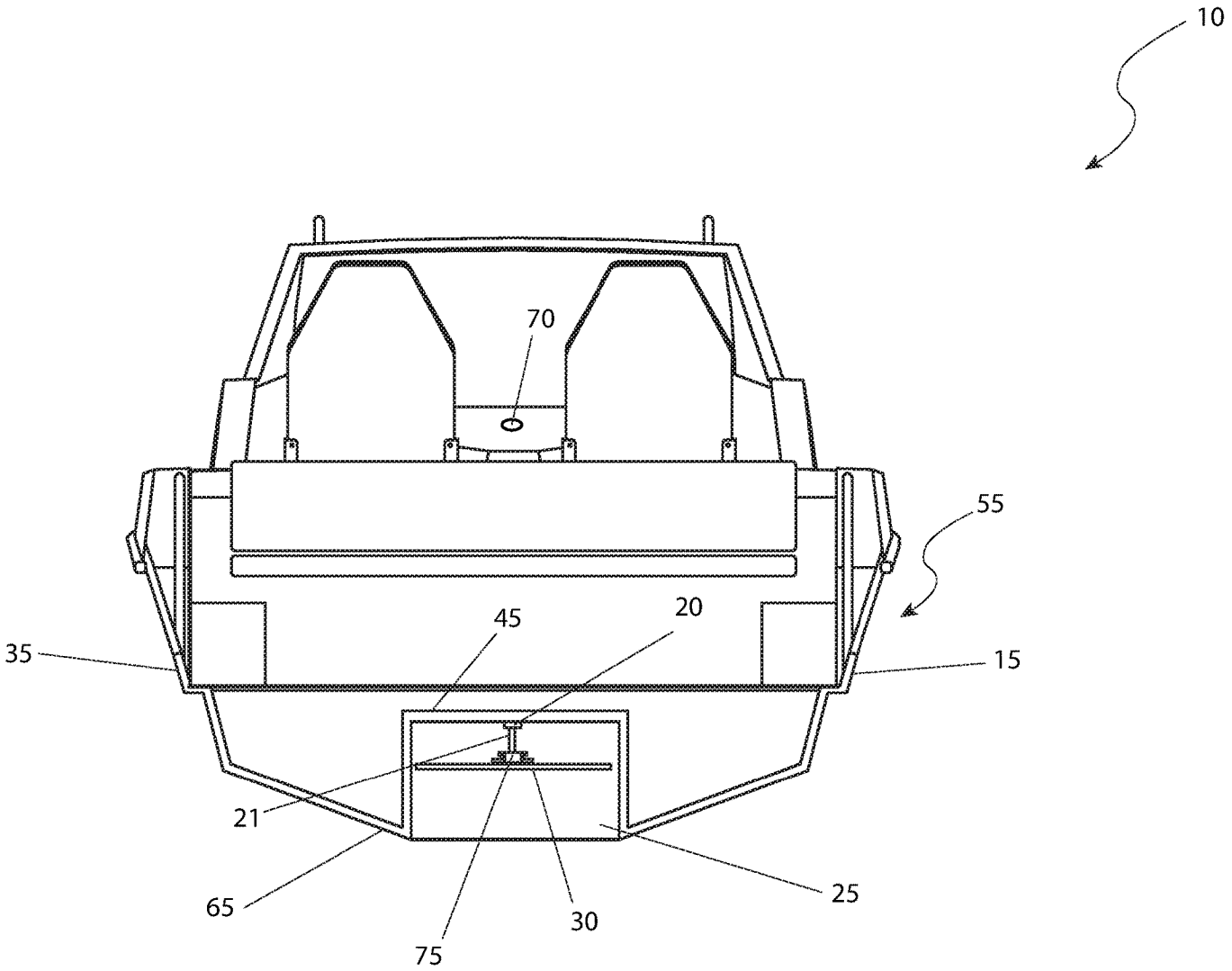
FIG. 2 is cross-section rear view of the watercraft 10, along the line I-I of FIG. 1, showing the adjustable hull 30 in a raised configuration.

Referring next to FIG. 2, a cross-section rear view of the watercraft 10, along the line I-I of FIG. 1, showing the adjustable hull 30 in a raised configuration is disclosed. This view discloses the central nature of the hydraulic cylinder 21 and the associated hydraulic piston 20. The hydraulic piston is connected to the adjustable hull 30 via a pivot point 75 to allow for angular displacement during the raising and lowering process. This configuration would be utilized in shallow water.

Figure 3:
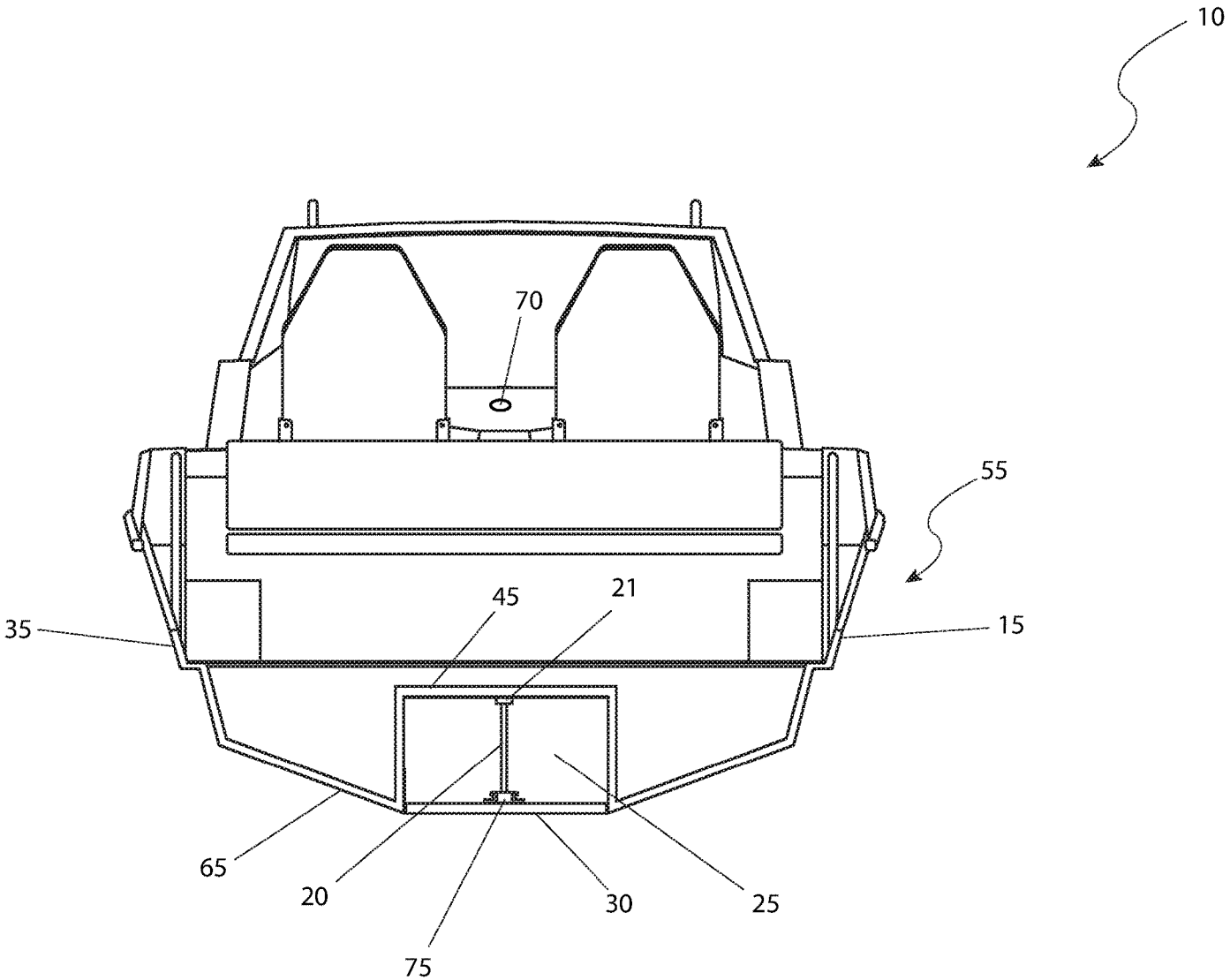
FIG. 3 is cross-section rear view of the watercraft 10, along the line I-I of FIG. 1, showing the adjustable hull 30 in a lowered configuration; and, FIG. 4 is cross-section rear view of the watercraft 10 in an alternate embodiment, along the line I-I of FIG. 1, showing the adjustable hull 30 with a manual lifting means 80 in a raised tunnel hull configuration.

Referring now to FIG. 3, a cross-section rear view of the watercraft 10, along the line I-I of FIG. 1, showing the adjustable hull 30 in a lowered configuration is depicted. This view once again discloses the central nature of the hydraulic cylinder 21 and the associated hydraulic piston 20, as well as the pivot point 75. This configuration would be utilized in deeper water, typically in conjunction with an outboard engine to allow for improved boat handling and higher rates of speed.

Figure 4:
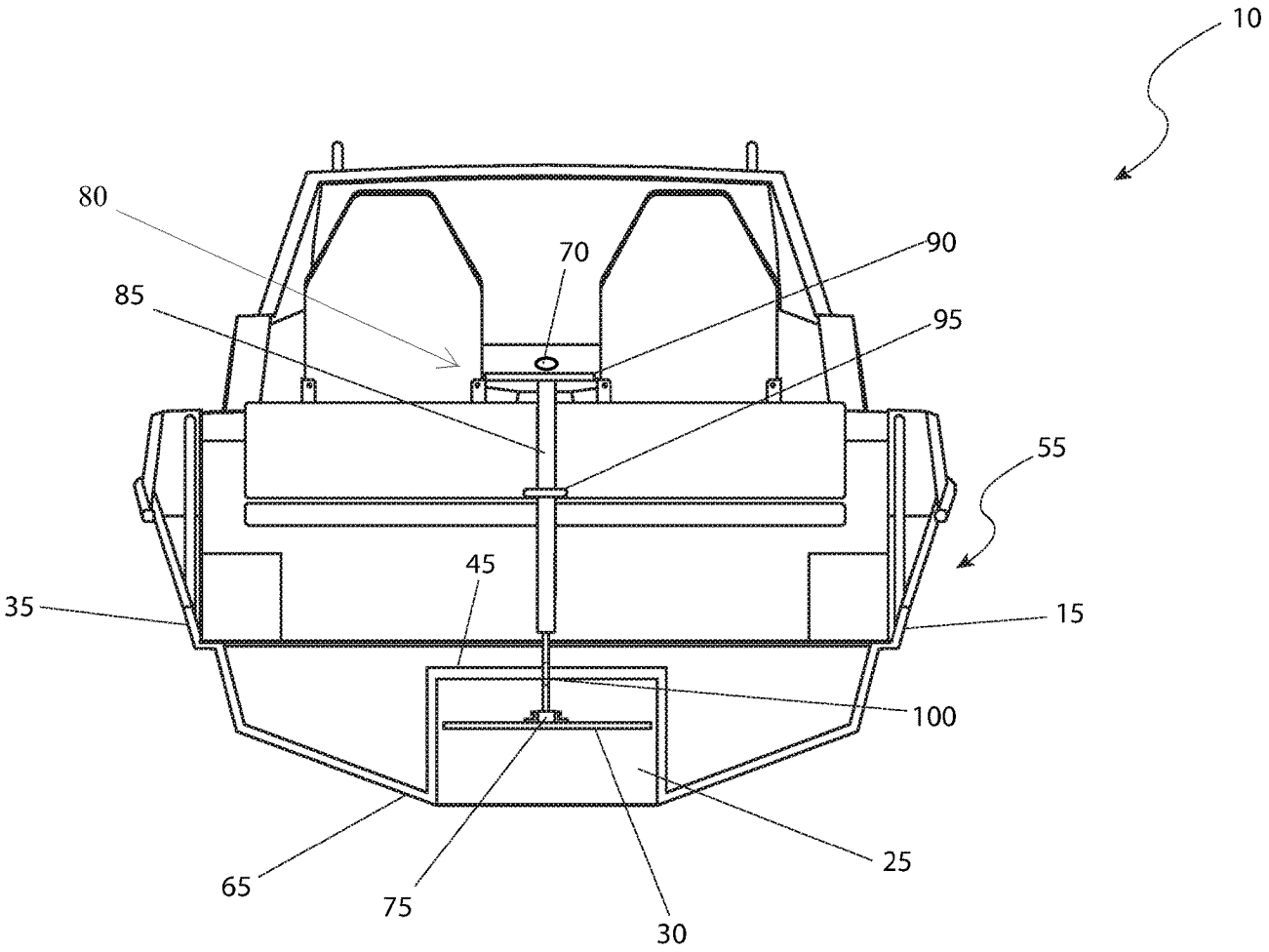

Referring finally to FIG. 4, a cross-section rear view of the watercraft 10 in an alternate embodiment, along the line I-I of FIG. 1, showing the adjustable hull 30 with a manual lifting means 80 in a raised tunnel hull configuration is shown. The alternate arrangement is similar to that disclosed in FIG. 2, except with the replacement of the hydraulic cylinder 21 and the associated hydraulic piston 20 with the manual lifting means 80. The manual lifting means 80 consists of a central shaft 85, a "T-shaped" top handle 90, and an adjustable locking means 95. During use, the operator of the watercraft 10 would grasp the top handle 90 and lift it up or down corresponding to a respective height adjustment of the adjustable hull 30 via the central shaft 85. The central shaft 85 is provided with an offset section 100, to allow for within the watercraft 10. Once proper height of the adjustable hull 30 has been obtained, the operator would secure the central shaft 85 in place via adjustable locking means 95, such as a locking pin, a locking collar, a clamp system or the like. The use of any particular style of adjustable locking means 95 is not intended to be a limiting factor of the present invention. Operation and benefits of the draft adjustable watercraft remain the same as aforementioned described in FIGS. 1 through 3.

The preferred embodiment of the present invention can be utilized by the common user in a simple and effortless manner with little or no training. It is envisioned that the watercraft 10 would be constructed in general accordance with FIGS. 1-4.

The watercraft 10 would be manufactured primarily of fiberglass, wood and or metal. An operator of the watercraft 10 would assess the need for a planing hull, a flat-bottom hull or a tunnel hull depending on the depth and intended use of the watercraft 10. Should the operator desire a flat-bottom hull or tunnel hull, the operator would actuate the switch 70 in a first position (not shown), thereby actuating each hydraulic mechanism in unison and raising the adjustable hull 30 into the interior void of the adjustable hull channel 25. Should the operator desire a planing hull, the operator would actuate the switch 70 in a second position (not shown), thereby actuating each hydraulic mechanism in unison and lowering the adjustable hull 30 out of the interior void of the adjustable hull channel 25. A similar operation would be required of the alternate embodiment by manipulation of the central shaft 85, the top handle 90, and the adjustable locking means 95.

The invention claimed is:

1. A watercraft, comprising:

a hull having an exterior hull channel within a hull bottom and adjacent a watercraft stem; and, an adjustable hull adjustably secured within said hull channel in mechanical communication with a hull adjustment assembly;

wherein said hull adjustment assembly permits a user to selectively raise or lower said adjustable hull within said hull channel;

wherein said hull adjustment assembly comprises a manual lifting mechanism; and wherein said manual lifting mechanism comprises a central shaft secured at a central shaft first end to said adjustable hull.

2. The watercraft of claim 1, wherein said manual lifting mechanism further comprises a handle secured to said central shaft at a central shaft second end.

3. The watercraft of claim 2, wherein said manual lifting mechanism further comprises a locking mechanism.

4. The watercraft of claim 3, wherein said locking mechanism is adjustable.

5. The watercraft of claim 1, wherein when said user moves said manual lifting mechanism in a first direction said adjustable hull is raised.

6. The watercraft of claim 5, wherein when said user moves said manual lifting mechanism in a second direction said adjustable hull is lowered.

7. The watercraft of claim 1, wherein said hull channel comprises a polygonal cuboid shape.

8. The watercraft of claim 1, where said adjustable hull comprises a polygonal cuboid shape.

* * * * *